United States Patent [19]

Kilroy et al.

[11] 4,349,983

[45] Sep. 21, 1982

[54] PLAYSET FOR TOY VEHICLES

[75] Inventors: Eugene J. Kilroy, Palos Verdes Estates; William J. Kelley, Torrance; Philip W. Crain, San Pedro, all of Calif.

[73] Assignee: Mattel, Inc., Hawthorne, Calif.

[21] Appl. No.: 232,758

[22] Filed: Feb. 9, 1981

[51] Int. Cl.[3] ..... A63H 33/00

[52] U.S. Cl. ..... 46/12; 46/11; 46/1 K; 238/10 A; 220/23.4

[58] Field of Search ..... 46/12, 1 K, 11, 1 C, 46/202, 43; 238/10 R, 10 A–F; 220/23.4, 4 C, 339, 335; 273/86 C, 86 B

[56] References Cited

U.S. PATENT DOCUMENTS

| | | | |
|---|---|---|---|
| Re. 23,949 | 2/1955 | De Matthaeis, Jr. | 238/10 A |
| Re. 26,642 | 8/1969 | Bender | 46/12 |
| 2,616,630 | 11/1952 | De Michele | 238/10 A |
| 3,769,743 | 11/1973 | Benkoe et al. | 46/1 C |
| 3,857,482 | 12/1974 | Shelton | 220/23.4 X |
| 4,285,157 | 8/1981 | Lambert | 46/1 K X |

FOREIGN PATENT DOCUMENTS

| | | | |
|---|---|---|---|
| 334453 | 3/1921 | Fed. Rep. of Germany | 46/11 |

*Primary Examiner*—Gene Mancene
*Assistant Examiner*—Mickey Yu
*Attorney, Agent, or Firm*—Ronald M. Goldman; Max E. Shirk; Roy A. Ekstrand

[57] ABSTRACT

A carrying case may be opened to present upper and lower scene-simulating objects including a serpentine roadway for toy vehicles which may coast down the roadway from the top of the rearwall of an upper carrying case portion to the bottom wall of a lower carrying case portion hinged to the upper carrying case portion along a diagonal line.

5 Claims, 11 Drawing Figures

Fig. 1,
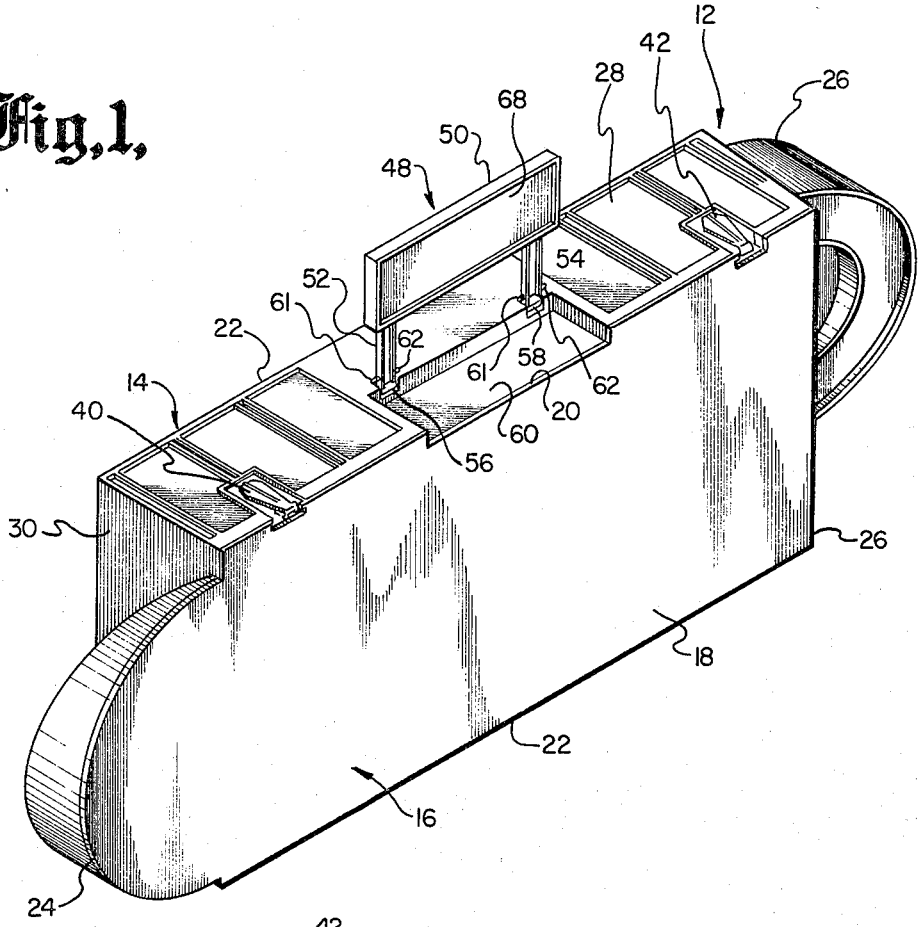
Fig. 2,
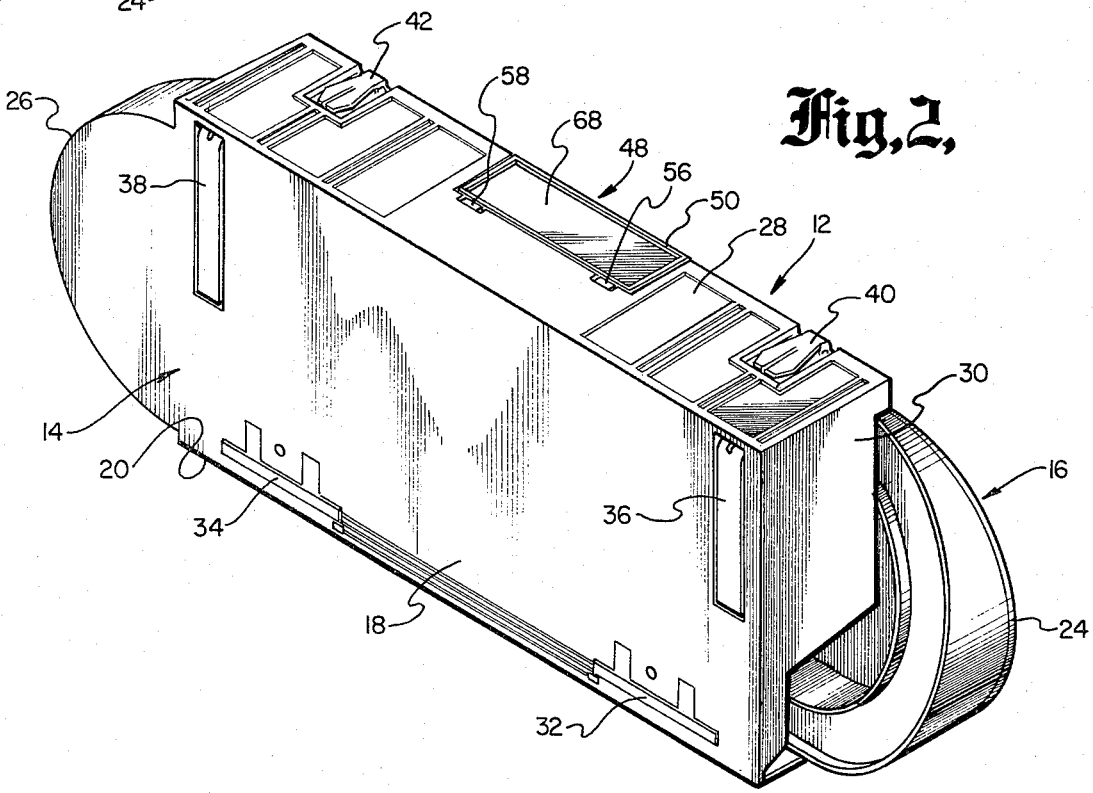

Fig,4,
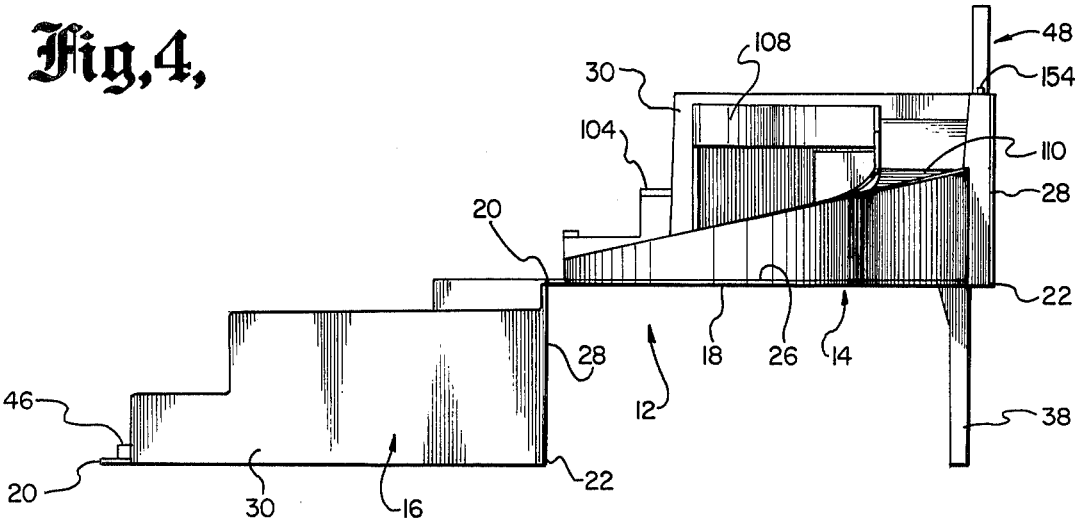
Fig,5,
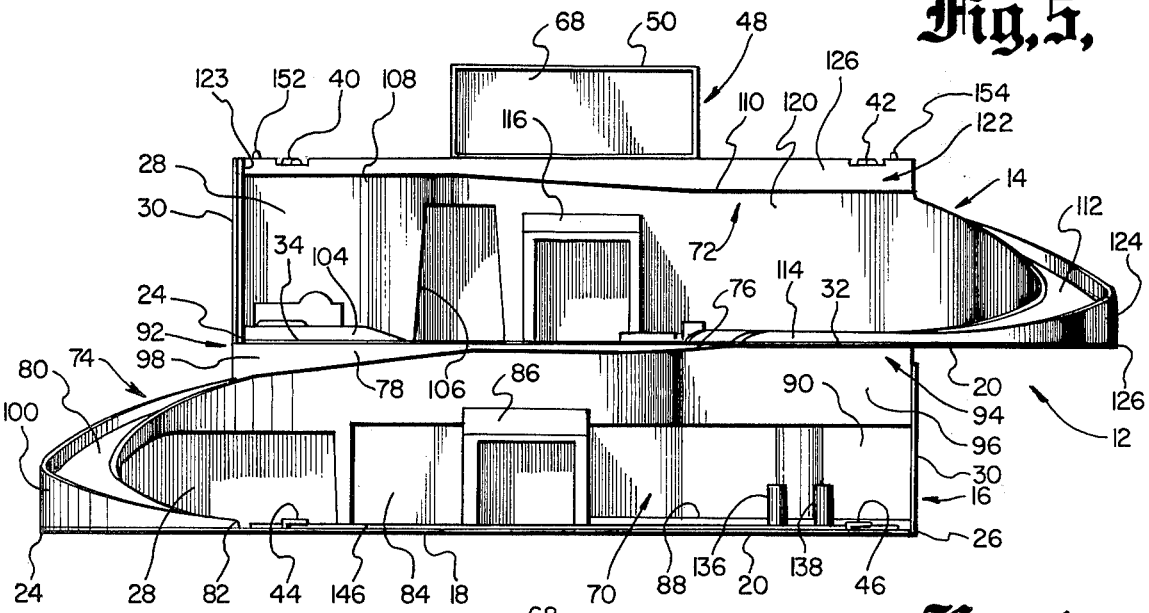
Fig,6,
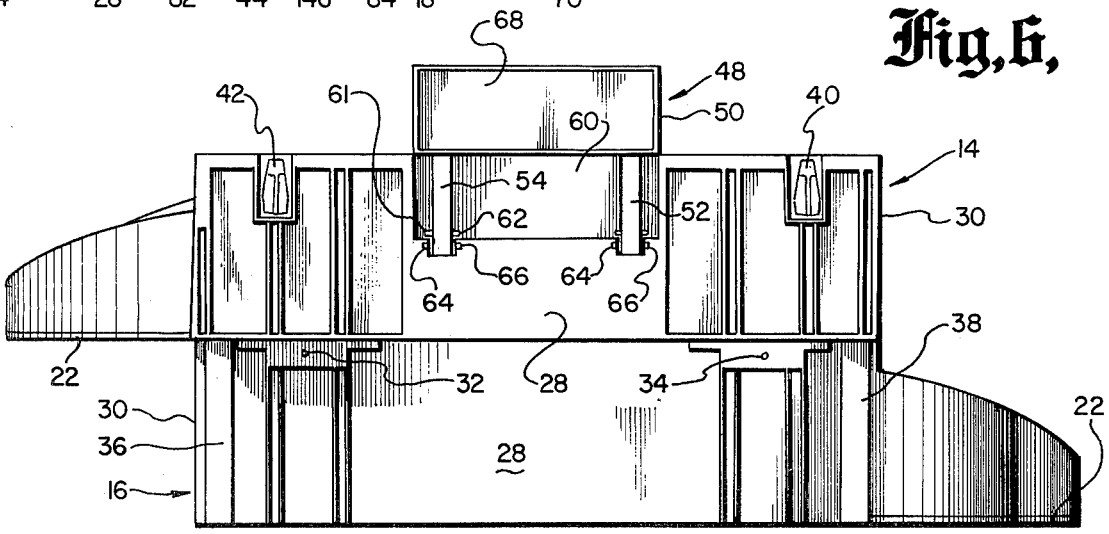

PLAYSET FOR TOY VEHICLES

BACKGROUND OF THE INVENTION

1. Field of the Invention

The present invention relates to playsets and more particularly to a new and useful playset providing roadways and other simulated scenes for toy vehicles.

2. Brief Description of the Prior Art

Pertinent prior art known to Applicants comprises U.S. Pat. No. Re. 26, 642. Generally speaking, this patent discloses a playset or carrying case of two box-like portions hinged together and having a molded plastic sheet secured to the inner face of each portion. The sheets are formed to define upstanding objects simulating the interior of a room, or other environment, when the case is open, and when the case is closed the objects of one portion project into the other portion and side walls of one box-like portion lie within corresponding walls of the other portion.

SUMMARY OF THE INVENTION

The present invention is directed, in brief, to the provision of a new and useful playset providing roadways and other simulated scenes for toy vehicles.

The best mode currently contemplated for carrying out the invention includes the provision of a carrying case having hinges connecting the top of a sidewall of one case portion to the bottom wall of the other case portion and supports pivotally connected to the bottom wall of the other case portion, whereby the bottom wall of said one case portion may be placed on a horizontal surface and said other case portion may be swung 180° about the hinges and supported by the hinges and the supports in a plane passing through the top of said sidewall of said one case portion.

The playset may also include scene-simulating objects such as a pathway for toy vehicles extending in serpentine fashion from the upper portion of said sidewall of said other case portion to the bottom wall thereof and thence along the top of the sidewall of said one case portion to the bottom wall thereof.

Additionally, the playsets may include suitable connectors for connecting a plurality of playsets together stairstep fashion using boxes, books or the like to support the upper tiers.

The features of the present invention which are believed to be novel are set forth with particularly in the appended claims. The present invention, both as to its organization and manner of use, together with further objects and advantages thereof, may best be understood by reference to the following description, taken in connection with the accompanying drawings in which like reference characters refer to like elements in the several views.

BRIEF DESCRIPTION OF THE DRAWINGS

FIG. 1 is a front perspective view of a playset constituting a presently-preferred embodiment of the invention showing the case portions closed;

FIG. 2 is a rear perspective view of the closed playset of FIG. 1;

FIG. 4 is a side elevational view in the direction of line 4—4 of FIG. 3;

FIG. 5 is a front elevation view in the direction of line 5—5 of FIG. 3;

FIG. 6 is a rear view of FIG. 5;

DESCRIPTION OF THE PREFERRED EMBODIMENT

Figure 3:
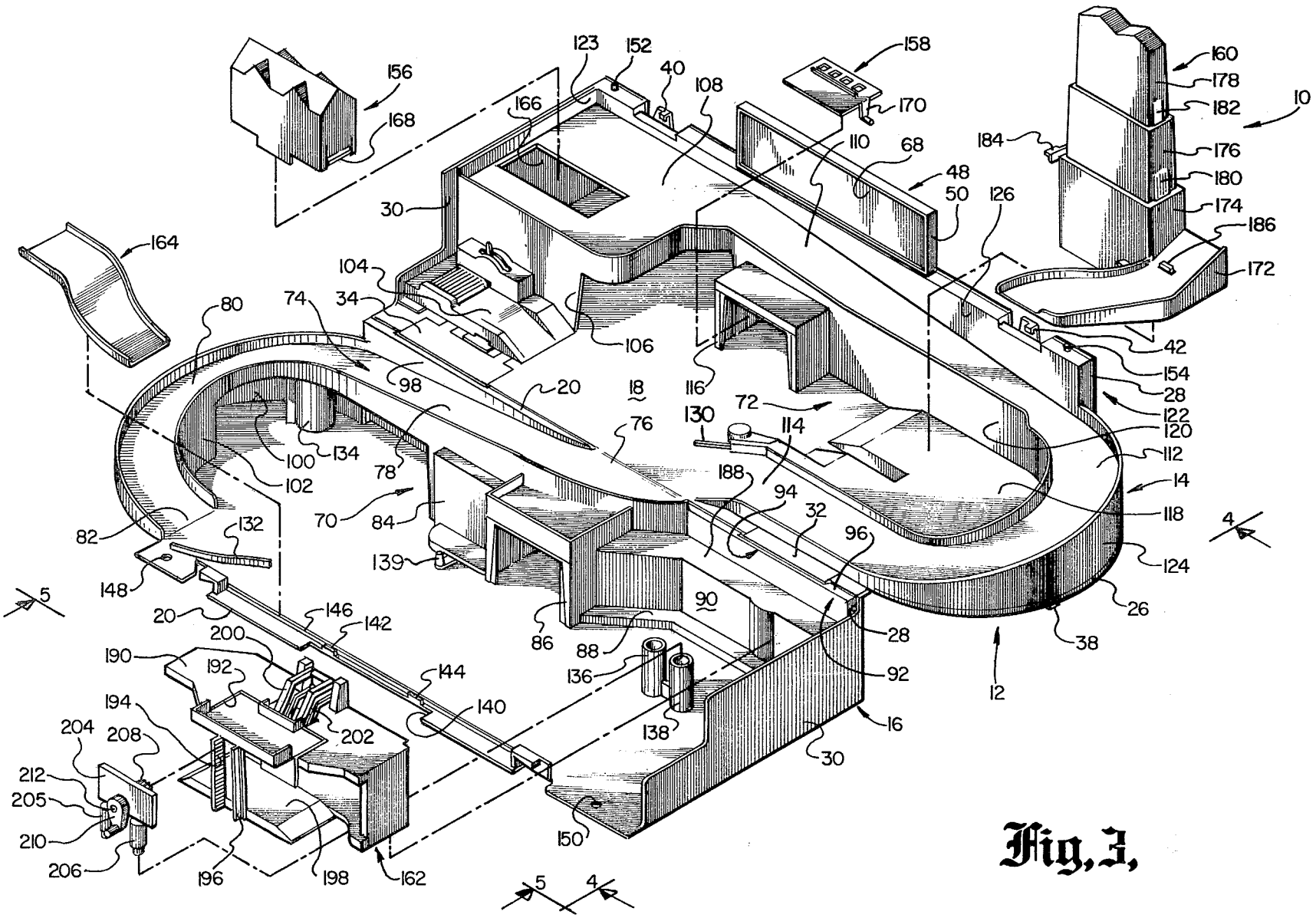
FIG. 3 is a perspective view of the playset of FIG. 1 showing the case portions open and showing exploded perspective views of scene-simulating accessories which may be used in the playset.

Referring again to the drawings and more particularly to FIGS. 1–6, a portable representation or playset constituting a presently-preferred embodiment of the invention, generally designated 10, includes a play case 12 having first and second carrying case portions 14, 16, respectively, each including a bottom wall 18 having a front edge 20, a rear edge 22, first and second side edges 24, 26, respectively, a first side wall 28 upstanding from rear edge 22 and a second side wall 30 upstanding from one of the side edges 24, 26 with one of the second side walls 30 being on the first side edge 24 and the other of the second side walls 30 being on the second side step 26.

Carrying case 12 includes a pair of hinges 32, 34 hingedly connecting front edge 20 of bottom wall 18 on carrying case portion 14 to the top of the first side wall 28 on carrying case portion 16 whereby carrying case 12 is hinged along a diagonal line so that, when bottom wall 18 of carrying case portion 16 is supported on a suitable surface and bottom wall 18 of case portion 14 is swung 180° about hinges 32, 34 from a closed position to an open position, bottom wall 18 of carrying case portion 14 will be put in a positive above, behind and parallel to bottom wall 18 of carrying case portion 16. Carrying case portion 14 may be supported in this position by hinges 32, 34 and a pair of supports or legs 36, 38 swingably connected to bottom wall 18 of case portion 14 adjacent rear edge 22 (FIGS. 2 and 6).

Carrying case 12 also includes a pair of latches 40, 42 which are pivotally mounted on back wall 28 of case portion 14 and which are engagable with fixed hooks 44, 46, respectively. provided on the front edge 20 of bottom wall 18 on case portion 16 to maintain case portions 14, 16 in closed position, as shown in FIGS. 1 and 2.

Carrying case 12 also includes a carrying handle 48 having a grip portion 50 from which a pair of legs 52, 54 depend. Legs 52, 54 are slidably mounted in apertures 56,58 provided in side wall 28 on case portion 14 adjacent a rectangular recess 60 adapted to house grip portion 50 when handle 48 is in its FIG. 2 position. Handle 48 may be moved from its FIG. 2 position to its FIG. 1 position by withdrawing leg 52, 54 from apertures 56. 58 and then swinging handle 48 upwardly until a pair of detents 61, 62 on each leg 52, 54 engaged the upper surface of side wall 28 at which time a pair of lugs 64, 66, which are provided on the lower end of each leg, will bottom-out on the undersurface of recess 60. Grip 50 includes a panel 68 upon which suitable indicia may be displayed to simulate a highway sign when carrying case 12 is opened to the configuration shown in FIG. 3.

Playset 10 also includes first and second sets of upstanding objects 70, 72 simulating a scene found in a selected human environment. Each set may be integrally formed from polymeric material by suitable molding techniques such as vacuum molding from a unitary sheet or injection molding styrene material. As best shown in FIGS. 3 and 5, the first set 70 includes a roadway 74 having an entrance portion 76 communicating with front edge 20 of case portion 14, a downwardly sloping portion 78 connecting entrance portion 76 to a curve section 80 curving downwardly around edge 24 of case potion 16 to an exit portion 82 on bottom wall 18 of case portion 16. The first set 70 also includes a simulated service station 84, a simulated garage 86, a simulated sidewalk 88 and simulated store fronts 90 all of which may be suitably decorated with decals (not shown). A support wall 92 is formed integrally with set 70 during the molding operation and includes a back wall 94 having a first portion 96 extending upwardly above store fronts 90 and rearwardly to side wall 28 and a second portion 98 extending upwardly above roadway 74 and rearwardly to side wall 28. Wall 92 also includes two curved portions 100, 102 connecting curved section 80 of roadway 74 to edge 24 of case portion 16.

Set 70 may be secured to the interior faces of bottom wall 18 and side wall 28 of case portion 16 using a suitable adhesive or sonic welding techiques. This may be accomplished by securing the first and second portions 96, 98 of back wall 94 to side wall 28 and by securing curved portions 100, 102 of wall 92 and exit portions 82 of curved section 80 to bottom wall 18.

The second set 72 includes a simulated vehicle test stand 104 formed integrally with a wall 106 supporting one end of a parking apron 108 from which a second roadway 110 extends downwardly along side wall 28 to a curved section 112 extending downwardly around end 26 of bottom wall 18 on case portion 14 to an exit section 114 on bottom wall 18. Set 72 also includes a simulated garage 116 and a second simulated vehicle test stand 118 formed integrally with a wall 120 supporting the second roadway 110. A support wall 122 is formed integrally with set 72 during the molding operation and includes a first end wall 123, a second end wall 124 and a back wall 126.

Set 72 may be secured to the interior faces of bottom wall 18 and side walls 28,30 by securing end wall 123 to side wall 30, back wall 126 to side wall 28, end wall 124 to edge portion 26 of bottom wall 18, and exit portion 114, test stands 104 and 118 and garage 116 to bottom wall 18.

A deflector bracket 130 is provided on bottom wall 18 of case portion 14 adjacent exit portion 114 of roadway 110 for directing toy vehicles from roadway 110 to the entrance portion 76 of roadway 74. Deflector 130, bottom wall 18, and side wall 28, 30 may be integrally molded from a suitable polymeric material, such as styrene, employing injection molding techniques.

Case portion 16 may also be molded from a suitable styrene material with bottom wall 18 and side wall 28, 30 being integrally formed. Additionally, a deflector 132 and hollow bosses 139, 136 and 138 may be integrally formed on bottom wall 18. Deflector 132 is positioned to be engaged by a vehicle exiting from exit portion 82 of roadway 74 and direct the vehicle into engagement with a lever 139 pivotally mounted on bottom wall 18 under simulated service station 84. The vehicle moves lever 134 into engagement with a bell (not shown) to simulate a conventional signal produced by a vehicle driving over a bell-ringing device at a gas pump. Roadway 74 may be affixed to boss 134 for adding support and rigidity to roadway 74 and for simulating a large column sometimes used to support conventional freeway overcrossings. Bosses 136, 138 may be used to secure accessory items to bottom wall 18, as will be described hereinafter. Front edge 20 of case portion 16 is provided with a rectangular notch 140, a pair of brackets 142, 144, which are mounted in notch 140, longitudinal rib 146 and a pair of apertures 148, 150. Additionally, a pair of protuberances 152, 154 are provided on wall 122 in alignment with apertures 148,150, respectively, for engagement with apertures 148, 150 on a second carrying case 12, (FIG. 7) for connecting two carrying cases together in stairstep fashion.

Referring now more in particular to FIG. 3, playset 10 also includes a plurality of accessories 156, 158, 160, 162 and 164 which may be connected to playset 12 to enhance the play value thereof. Accessory 156 simulates a building and may be reciprocably mounted in an opening 166 provided in parking apron 108. Building 156 is provided with a pair of spring clips like the one shown at 168, for retaining building 156 in an elevated position. Building 156 may then be lowered down to bottom wall 18 when it is desired to close carrying case 12 at which time the scene-simulated objects in one case portion will be accomodated in the interior open space in the other case portion.

Accessory 158 simulates a garage door for garage 116 and may be connected thereto by a pair of pivot arms, like the one shown at 170. Accessory 160 simulates a skyscraper to which a vehicle ramp 172 is affixed. Skyscraper 160 includes a bottom section 174 to which an intermediate section 176 and an upper section 178 are telescopically connected by spring clips 180, 182, respectively. Skyscraper 160 carries a lever 184 which is connected to a lug 186 on ramp 172 for lowering lug 186 beneath the upper surface of ramp 172 when it is desired to release a toy vehicle (not shown) for travel down ramp 172. When skyscraper 160 and ramp 172 are mounted on simulated test stand 118, lever 184 may be actuated to release a car simulating a policeman pursuing a vehicle traveling down exit portion 114 of roadway 110.

Accessory 162 simulates an elevator for elevating a toy vehicle from bottom wall 18 to the roof 188 on top of simulated store front 90 when elevator 162 is affixed to side wall 88. Elevator 162 includes a top wall 190, which is provided with a rectangular opening 192, a pair of spaced-apart vertical racks 194, 196 and a platform 198 to which a pair of parallel arms 200, 202 are connected for elevating platform 198. Elevator 162 also includes an actuating mechanism 204 which may be affixed to hollow bosses 136, 138 by a pair of posts 205, 206, respectively, depending from actuating mechanism 204. Actuating mechanism 204 includes a pinion 208 which may be engaged between racks 194, 196 for elevating platform 198 when a crank 210, which is affixed to pinion 208 by a shaft 212, is actuated.

Figures 7, 8, 9, 10, 11:
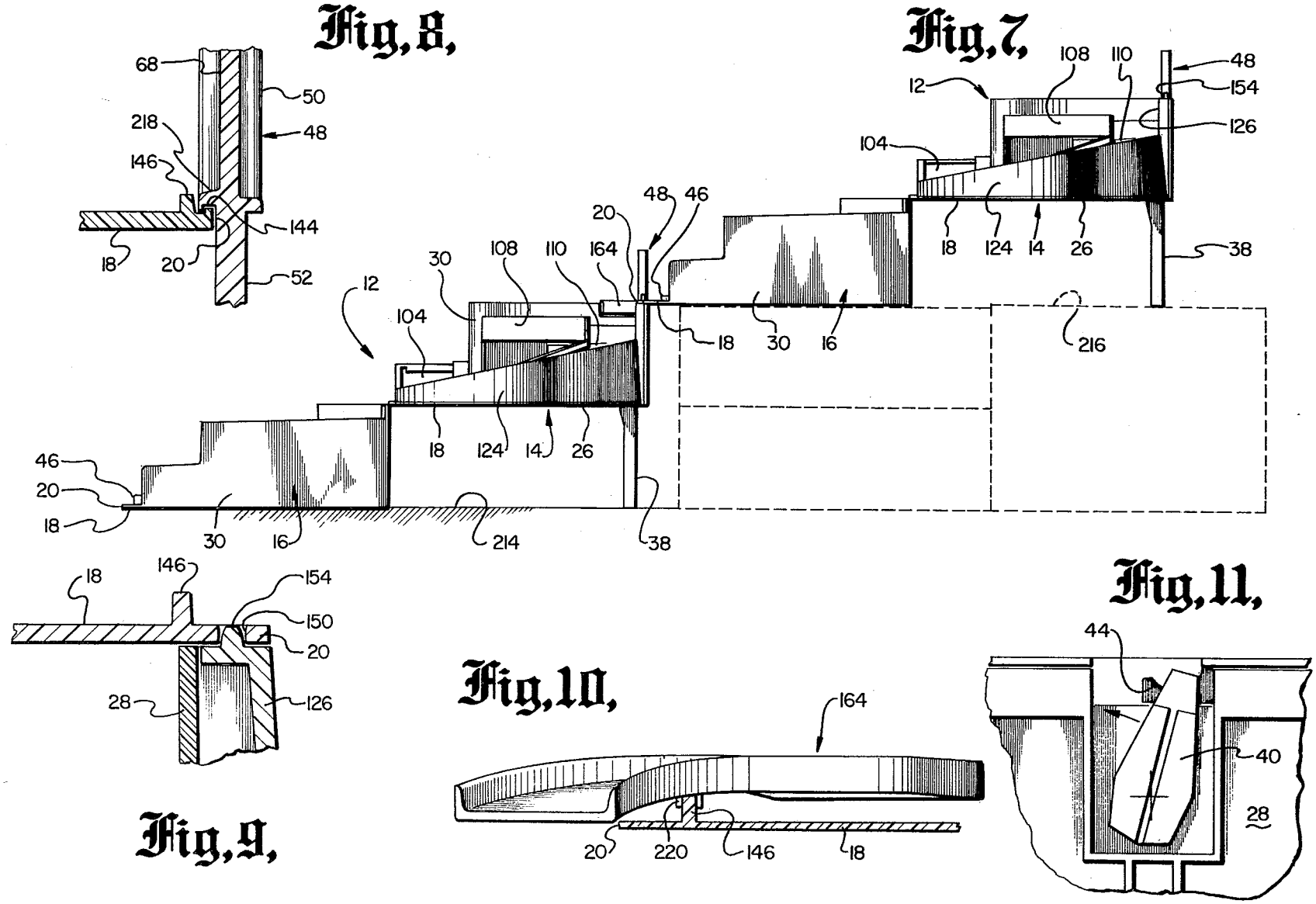
FIG. 7 is a side elevational view of two playsets connected together in stairstep fashion.
FIGS. 8 and 9 are enlarged, partial cross-sectional views of connectors for connecting playsets together.
FIG. 10 is an enlarged perspective view of a roadway section forming a pathway for a toy vehicle travelling from the upper playset to the lower playset in FIG. 7.
FIG. 11 is an enlarged, partial elevational view of a latch for holding the case portions in closed positions.

Referring now to FIG. 3 and 7–10, two carrying cases 12 may be connected together in stairstep fashion by placing case postion 16 of a first carrying case 12 on a suitable surface 214, opening case portion 14, extending legs 36, 38 into engagement with surface 214 and then supporting a second playcase 12 on an elevated surface 216, which may be formed by stacking a plurality of cardboard boxes, or the like, on surface 214. The front edge 20 of the upper case portion 16 may then be connected to the top edge of wall 126 by engaging apertures 148, 150 on the upper case portion 16 over protuberances 152, 154, respectively, provided on the lower case portion 14 and by engaging a pair of hooks, like the ones shown at 218 in FIG. 8, which are provided on the rear side of handle 48 of the lower case portion 16, over clips 142,144 on the front edge 20 of upper case portion 16. Case portion 14 may be supported on surface 216 by legs 36, 38. Accessory 164 may then be used to connect exit portion 82 of trackway 74 on the upper case portion 16 to roadway 110 on the lower case portion 14 by engaging a U-shaped bracket 220, which is provided on the lower surface of accessory 164, as shown in FIG. 10, on rib 146 on the front edge 20 of the upper case portion 16.

Use of playset 10 is believed to be apparent from the foregoing and will be briefly summarized in connection with FIGS. 3 at this point.

A toy vehicle having free-rolling wheels may be placed on apron 108 and pushed onto roadway 110 whereupon the vehicle will coast down roadway 110, around curve portion 112 and out exit portion 114 onto bottom wall 18. The vehicle will then be deflected by deflector 130 into the entrance portion 76 of roadway 74 whereupon the vehicle will continue down section 78, around curved portion 80 and out exit portion 82 onto bottom wall 18 whereupon deflector 132 will deflect the vehicle into engagement with arm 134, thereby ringing the bell in simulated service station 84.

If, on the other hand, carrying case 12 is the upper carrying case in FIG. 7, the vehicle will pass from exit portion 82 onto the section of roadway represented by accessory 164 which will direct the vehicle onto the upper end of roadway 110 on the lower case portion 16. The vehicle will then travel the route previously described until it exits at exit portion 82 on lower case portion 16.

While the particular playset herein shown and described in detail is fully capable of attaining the objects and providing the advantages hereinbefore stated, it is to be understood that it is merely illustrative as the presently-preferred embodiment of the invention and that no limitations are intended to the details of construction or design herein shown other than defined in the appended claims which form a part of this disclosure.

Whenever the term "means" is employed these claims, this term is to be interpreted as defining the corresponding structure illustrated and described in this specification or the equivalent of the same.

What is claimed is:

1. In combination with a portable representation including an openable and closeable carrying case having two case portions, each of said case portions having a bottom wall and a sidewall, a first unitary sheet secured to the interior of one of said case portions, a second unitary sheet secured to the interior of the other of said case portions, each of said sheets having integrally formed therewith a plurality of objects simulating a scene found in a selected human environment, said carrying case having sufficient interior room to accomodate said scene-simulating objects without interference when closed to serve as a storage and carrying means therefore, the improvement which comprises:

first means for hingedly connecting the top of a sidewall of one of said case portions to the bottom wall of the other of said case portions;

supports depending from said bottom wall of said other case portion, said supports having a length corresponding to the height of said sidewall of said one of said case portions, whereby the bottom wall of said one case portion may be placed on a horizontal surface and said other case portion may be swung 180° about said first means whereupon said supports and said first means will support said other case portion in a horizontal plane passing through the top of said sidewall of said one of said case portions; and second means on the front edge of the bottom wall on said one case portion and third means adjacent the upper edge of the sidewall on said other case portion for connecting the front edge of the bottom wall of said one case portion to the upper edge of the sidewall on a second carrying case having structure corresponding to said third means, the sidewall on said other case portion and said bottom wall on said one case portion, said scene-simulating objects including a pathway for toy vehicles extending in serpentine fashion from the upper portion of a sidewall of said other case portion to said bottom wall thereof and thence along said top of the sidewall of said one of said case portions to the bottom wall thereof.

2. An improvement as recited in claim 1 wherein said scene-simulating objects also include simulated buildings normally associated with automobiles and roadways.

3. A playset for toy vehicles, comprising:

a carrying case having first and second carrying case portions each including a bottom wall having a front edge, a rear edge, a first side edge and a second side edge, a first side wall upstanding from said rear edge and a second side wall upstanding from one of said first and second side edges, one of said second side walls being on said first side edge and the other of said second sidewalls being on said second side edge;

means hingedly connecting a front edge of one of said bottom walls to the top of the first sidewall upstanding from the rear edge of the other of said bottom walls;

at least one support leg pivotally connected to underside of said one bottom wall adjacent said rear edge thereof, whereby said one bottom wall may be supported above and behind said other bottom wall with the free end of said support engaging the plane in which said other bottom wall lies; and a roadway for said toy vehicles, said roadway including a first portion extending from a position adjacent the upper edge of the corner formed by the first and second sidewalls on said one bottom wall downwardly and around the side edge of said one bottom wall opposite said second sidewall upstanding therefrom to a terminus on the upper surface of said one bottom wall, said roadway also including a second portion extending from a position adjacent said terminus and the top of said first sidewall on said other bottom wall downwardly and around the side edge of said other bottom wall opposite said second sidewall upstanding therefrom to a terminus on the upper surface of said other bottom wall adjacent the front edge thereof.

4. A playset as recited in claim 3 including first means on said front edge of said other bottom wall and second means adjacent the upper edge of the first sidewall on said one bottom wall for connecting the front edge of said other bottom wall to the upper edge of the sidewall of a second playset having structure corresponding to said second means, said first sidewall and said one bottom wall.

5. A playset as recited in claim 4 including a roadway section connecting the roadways in said playsets together.

* * * * *